US005689885A

United States Patent [19]

Walston

[11] Patent Number: 5,689,885

[45] Date of Patent: Nov. 25, 1997

[54] KNIFE WITH BLADE-MOUNTED PIVOTAL LOCKBACK LATCH

[76] Inventor: Andrew L. Walston, 325 N. 160th St., Seattle, Wash. 98133

[21] Appl. No.: 629,076

[22] Filed: Apr. 8, 1996

[51] Int. Cl.[6] ..... B26B 1/04

[52] U.S. Cl. ..... 30/160; 30/161

[58] Field of Search ..... 30/160, 161, 155, 30/153, 151, 330

[56] References Cited

U.S. PATENT DOCUMENTS

| | | | |
|---|---|---|---|
| 847,206 | 3/1907 | Saunderson | 30/160 X |
| 4,073,057 | 2/1978 | Gilbert | 30/153 |

*Primary Examiner*—Douglas D. Watts
*Attorney, Agent, or Firm*—Ronald M. Anderson

[57] ABSTRACT

A folding knife having a blade that is easily opened and locked in an open position. Three embodiments of a folding knife (10, 10', 10") include a lever (20, 20') that is pivotally attached to a blade (14, 14') at a point spaced apart from that at which the blade is pivotally mounted to a handle (12, 12'). When fully closed, a sharpened edge (26) of the blade is protected inside the handle. To open the blade, the lever is gripped between the thumb and forefinger and rotated about the pivot point of the lever, forcing the sharpened edge of the blade from inside the handle. The lever may then be pulled to draw the blade to a fully open position. A contoured latching surface on the lever is then engaged with a hook in a back strip (32, 32', 32") in the handle, locking the blade fully open. Since a top surface (38, 38') of the lever is relatively wider than the thickness of a spine (top edge) of the blade, the user can comfortably and safely exert greater force against the top surface of the lever when cutting with the knife than is possible with a conventional knife.

26 Claims, 6 Drawing Sheets

KNIFE WITH BLADE-MOUNTED PIVOTAL LOCKBACK LATCH

FIELD OF THE INVENTION

This invention generally pertains to knives having blades that fold into a slot in a handle when not in use, and more specifically, to folding knives that include a blade lockback mechanism to lock the blade in an open position.

BACKGROUND OF THE INVENTION

Knives are often carried in a scabbard to protect the blade from damage and to prevent the sharp edge on the blade from accidentally cutting the user or some other object that it contacts. While scabbards are appropriately used for larger knives, such as those carried while hunting game or fishing, smaller knives intended for general purpose use are more conveniently carried in a pocket. Such knives are typically designed so that each blade is pivotally mounted to a handle, enabling the blade to be folded, rotating the sharp edge into a protective slot formed in the handle. When the blade is thus folded, the knife can be safely carried in the user's pocket. Other techniques for enclosing the blade to enable a knife to be carried include designs in which the blade retracts longitudinally into the handle (spring knife), or is actuated by a spring to pivot rapidly from a closed position to the open position (a switchblade knife), or those in which two slotted portions of the handle pivot to fully enclose the blade (a butterfly knife). However, such knives are illegal in some states and thus, are not further discussed.

There are two problems with conventional folding knives. The blade of a conventional folding knife can unexpectedly pivot toward its closed position while in use. During use, the handle of a pocket knife is normally grasped in a user's hand, with the fingers curled around the slot in which the blade edge is protected when the blade is closed. If the blade unexpectedly pivots toward the closed position, the sharp edge can easily cut the user's fingers, inflicting a painful and possibly serious injury. Although the application of force against the cutting edge of the blade will normally tend to keep the blade in its fully open position, it is not unusual to occasionally apply force against the point of the blade. Pocket knives tend to be used for a variety of purposes other than simply cutting, so that the risk of a force being applied to the blade that causes it to fold unexpectedly is relatively high. If the user's hands are wet, a knife may rotate about the longitudinal axis of the handle, thereby shifting the direction in which force is applied to the blade, causing the blade to fold toward the user's fingers or hand.

Recognizing that such accidents happen too frequently, blade lockback mechanisms have previously been developed to latch a knife blade in the open position. Only after a user intentionally actuates a blade release on such knives, can the blade edge be folded back into the handle. Lockback mechanism are also used on folding knives that are too large to be conveniently carried in a pocket and are instead carried folded in a compact scabbard or sheath. These larger lockback folding knives, which are more compact that a typical non-folding hunting knife, are often used for skinning game or cleaning fish. The lockback feature prevents an unintended folding of the knife blade while game is being cleaned.

The second problem with folding knives relates to the effort required to open the blade from its fully closed position. Most such knives include a groove that extends parallel to and adjacent to the spine of the blade so that the groove can be engaged with a thumbnail to draw the blade open. However, the handle of the knife typically includes a thin strip of steel secured between the two sides of the handle, designed to apply a spring force against the blade. This strip seats on a flat portion of the blade, adjacent the pivot point, and applies a force tending to keep the blade closed and protected within the slot of the handle. Often, the force holding the blade within the handle is so great that a user's nail may break or bend before the blade yields and pivots open. In addition, once the blade is pivoted part way toward its fully open position, the user may accidentally release the blade, allowing the spring tension of the steel strip to close the knife blade against the user's fingers or hand, causing an injury.

There is another problem that arises in connection with almost all conventional knives and is not limited to folding knives. When a knife is used for cutting an object, e.g., for whittling on a stick of wood, the user typically grasps the handle of the knife with the cutting edge facing away from the user's body and applies force through the handle to the blade. Thus, there is an inherent twisting of the blade back toward the user because the force is not applied in-line with the blade. To compensate for this problem so as to apply maximum force to a blade of a knife, most users extend the thumb of their hand that is holding the handle to press directly against the spine (top edge) of the blade. However, because the blade of knife is relatively thin, even though typically thicker along the spine, the amount of force that can be exerted with the thumb in this manner, without incurring pain, is surprisingly limited. The spine of a knife blade is typically too thin to comfortably support significant force exerted by the pad of the thumb or other digit.

In view of the foregoing, it will be evident that it would be desirable to provide a folding knife designed to open more easily than conventional folding knives. The knife should also include a lockback feature to minimize risk of injury to the user due to an unexpected closure of the blade or due to accidental cuts that may occur while the knife blade is being opened or closed. It would also be desirable to provide a larger surface for the user's thumb (or other digit) at the spine of a knife blade to enable the user to more comfortably apply force to the blade. Furthermore, it would be desirable to provide these features in a knife that has a novel and pleasing appearance.

SUMMARY OF THE INVENTION

The present invention is embodied in a knife having both an aesthetically pleasing appearance and providing one or more of the novel features noted above. The knife includes a handle formed to be held comfortably within a user's hand and having a longitudinally extending slot that protects a cutting edge of a blade. The blade is pivotally attached to the handle at a first point adjacent one end of the blade and is rotatable between a closed position in which the cutting edge is disposed within the slot and an open position in which the cutting edge is exposed. A lever is pivotally attached to the blade at a second point, spaced apart from the first point. The lever has a gripping portion that remains exposed outside the slot when the blade is in the closed position. The gripping portion is adapted to be grasped between a user's thumb and forefinger and pulled outwardly away from the handle to rotate the lever about the second point. Rotation of the lever in this manner causes an edge of the lever on the end opposite the gripping portion to slide against the handle, forcing the blade from within the slot and toward its open position. Accordingly, it is not necessary for the user to directly grip the blade to open it (or to close it), and possible injury while opening or closing the blade is minimized. As the blade reaches the open position, the lever is then further rotated to a position in which it engages the handle, locking the blade in the open position.

The handle comprises two grips, each disposed on opposite sides of the slot and a back strip that is disposed between the two grips, opposite the slot in the handle. In one embodiment, the back strip is spring biased to a position between the two grips. An end of the back strip is forced outwardly of the handle, from between the two grips, as the blade is opened.

The back strip includes a hook that engages the lever to lock the blade in the open position. Other embodiments of the lever are provided for locking the blade open. In one embodiment, a contoured surface on the lever preferably latchingly engages a mating portion on the back strip. In one preferred embodiment, the gripping portion of the lever comprises opposed side walls that at least partially enclose the contoured surface. The gripping portion of the lever is preferably thicker than the blade and provides a surface against which the user can more comfortably exert force when using the knife.

BRIEF DESCRIPTION OF THE DRAWING FIGURES

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENT

FIGS. 1–4 illustrate a first preferred embodiment for a folding knife 10 in accord with the present invention. In FIGS. 1A–1E, folding knife 10 is shown in a sequence of side views that illustrate how a blade 14 of the folding knife is initially opened from its closed position, as shown in FIG. 1A, and is pivoted to a fully open lockback position, as shown in FIG. 1E. Folding knife 10 includes a contoured handle 12 comprising two opposed side grips 12*a* and 12*b*. In the sequence of views shown in FIGS. 1A–1E, only side grip 12*a* is illustrated; however, side grip 12*b* is substantially a mirror image of side grip 12*a*.

Figure 1A:
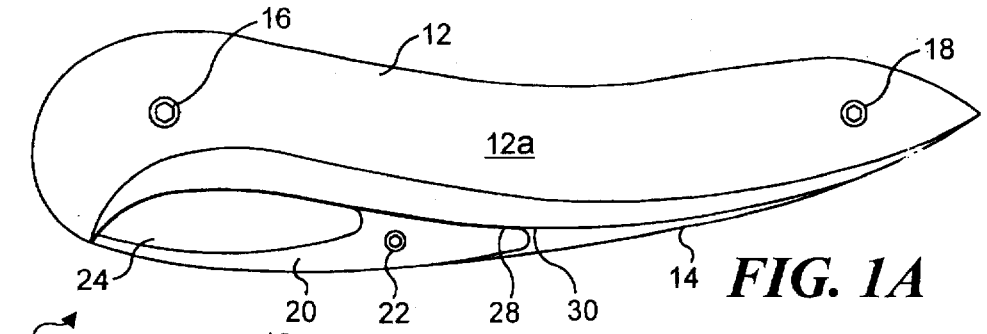
FIGS. 1A through 1E are side views of a first embodiment of a knife in accord with the present invention, showing a sequence of blade positions, starting with the blade fully closed in FIG. 1A and locked fully open in FIG. 1E.
Figure 1B:
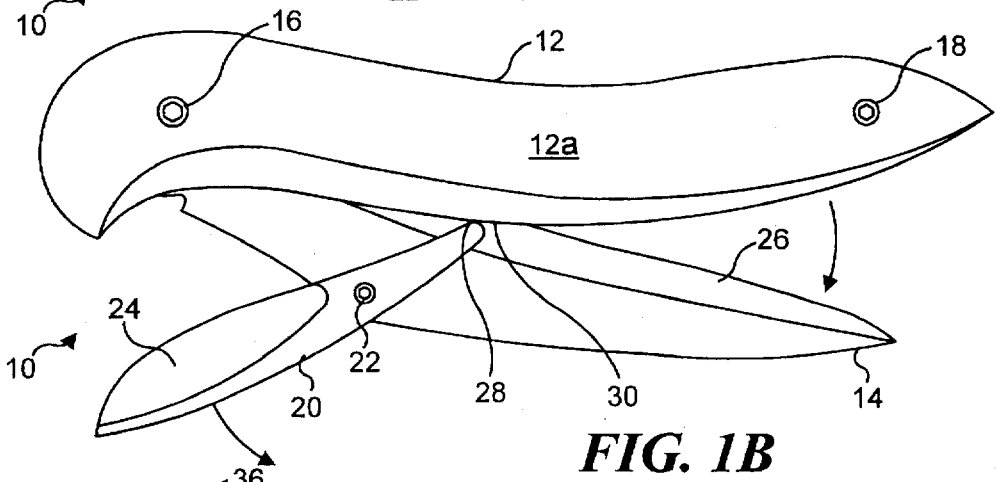
Figure 1C:
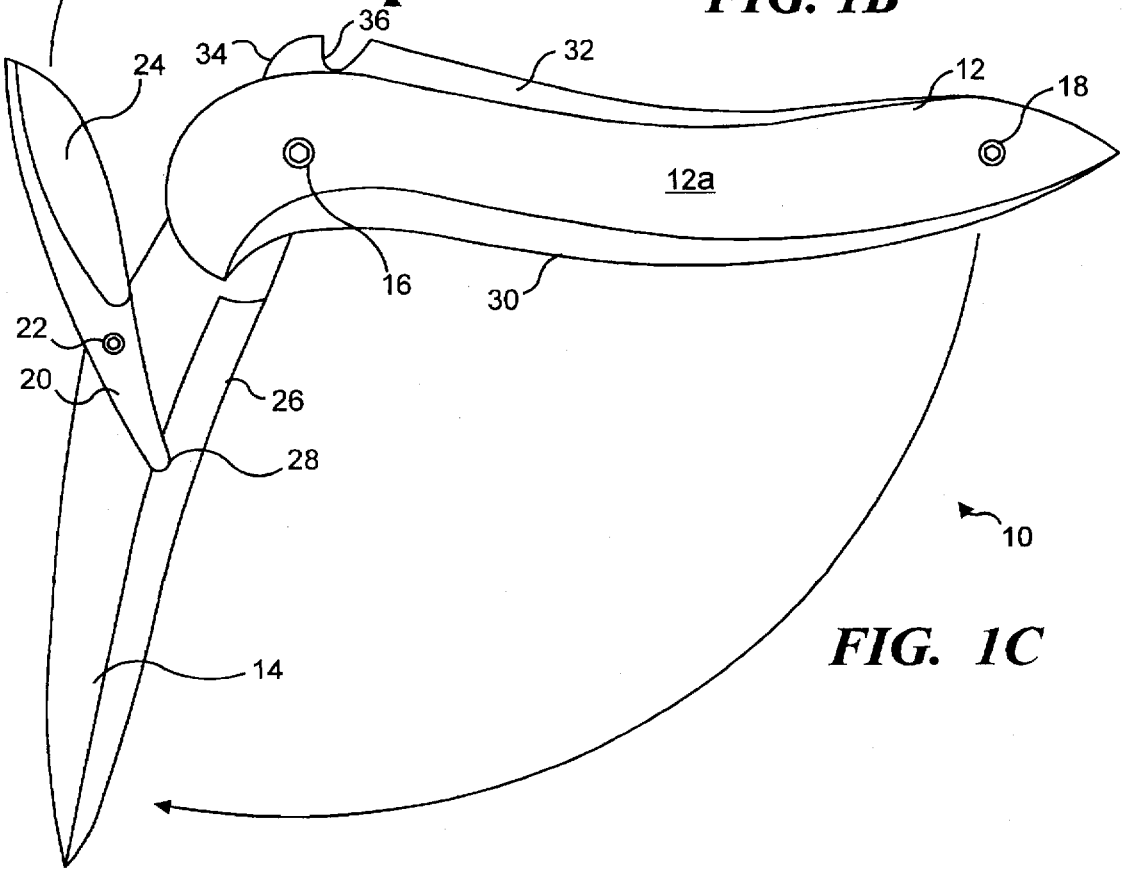

To facilitate replacement of blade 14 or other components that might require repair or replacement, folding knife 10 is preferably assembled using threaded Allen screws 16 and 18 (or other threaded fasteners). Both of these threaded Allen screws serve to couple side grips 12*a* and 12*b* together. In addition, the center of threaded Allen screw 16 defines a pivot point for blade 14, about which the blade rotates in an arc from the fully closed position shown in FIG. 1A, to the fully open position of FIG. 1E. In addition, threaded Allen screw 18 defines a pivot point for one end of a back strip 32. An end 34 (opposite the end secured by threaded Allen screw 18) moves about this pivot point through a limited arc, moving outwardly from between side grips 12*a* and 12*b* as blade 14 is rotated toward the open position. This rotation of back strip 32 exposes a contoured notch 36, which is shown in FIG. 1C. Contoured notch 36 is used for locking blade 14 in the open position, as described below.

A lever 20 is pivotally mounted on blade 14 using a threaded Alien screw 22. The pivot point for lever 20 defined by the center of threaded Allen screw 22 is adjacent the spine of blade 14 and is spaced apart from the pivot point for the blade that is defined by the center of threaded Allen screw 16. Lever 20 is preferably slotted so that one end of it straddles the blade as the lever pivots about the pivot point defined by threaded Allen screw 22. Although only one cam surface 28 is shown in FIGS. 1A through 1E, two cam surfaces are disposed along the edge of the lever, on opposite sides of blade 14, adjacent this end of the lever. The cam surfaces disposed adjacent each side of blade 14 contact sliding surfaces 30 that extend along the edges of side grips 12*a* and 12*b* adjacent the slot or opening in handle 12 in which a sharpened edge 26 of blade 14 is protected when the blade is fully closed.

At the opposite end of lever 20 from that at which cam surfaces 28 are disposed, are gripping surfaces 24. In folding knife 10, gripping surfaces 24 are contoured inwardly (i.e., slightly relieved) relative to the width of a top surface 38 to enable a user to readily grasp the gripping surface with an opposed force exerted by the thumb and forefinger. Gripping surfaces 24 are exposed on opposite sides of lever 20 when blade 14 is in the closed and open position.

Figure 1D:
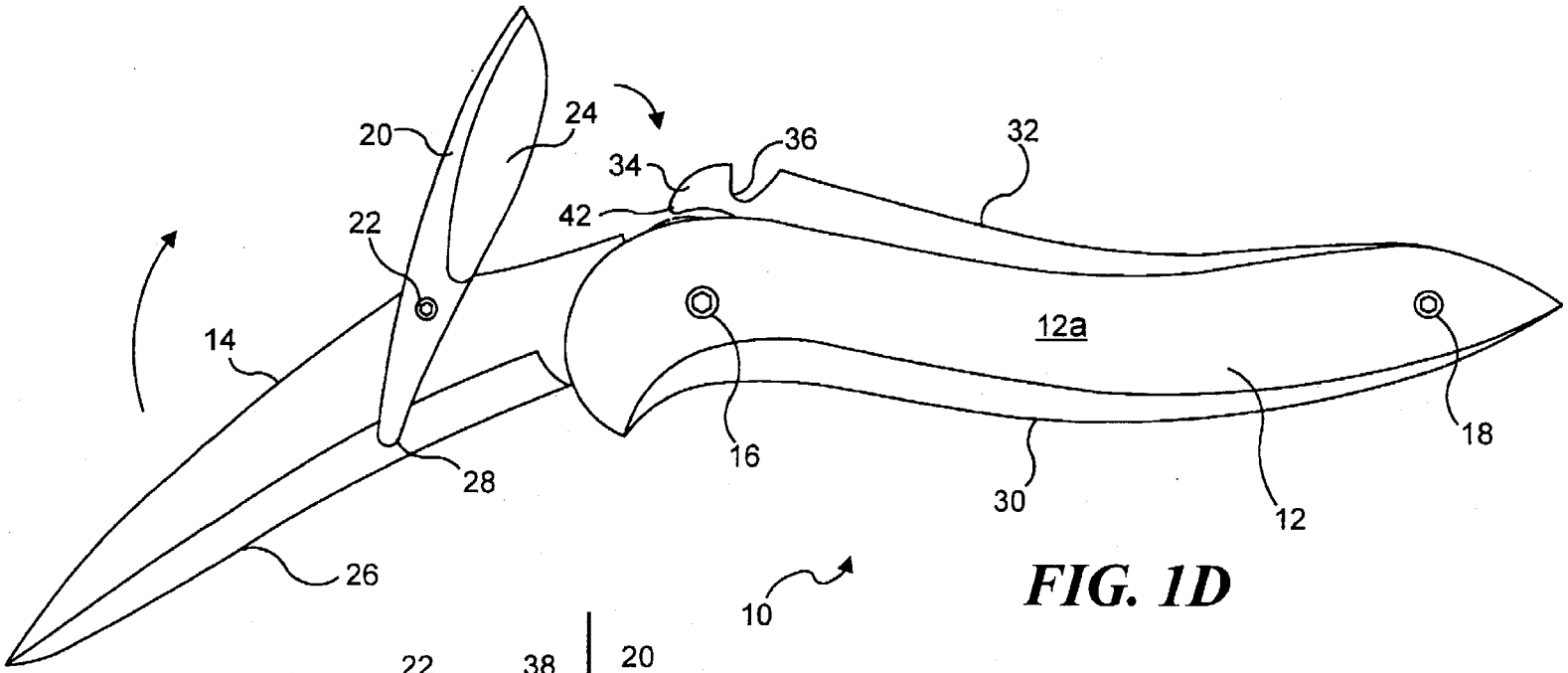
Figure 1E:
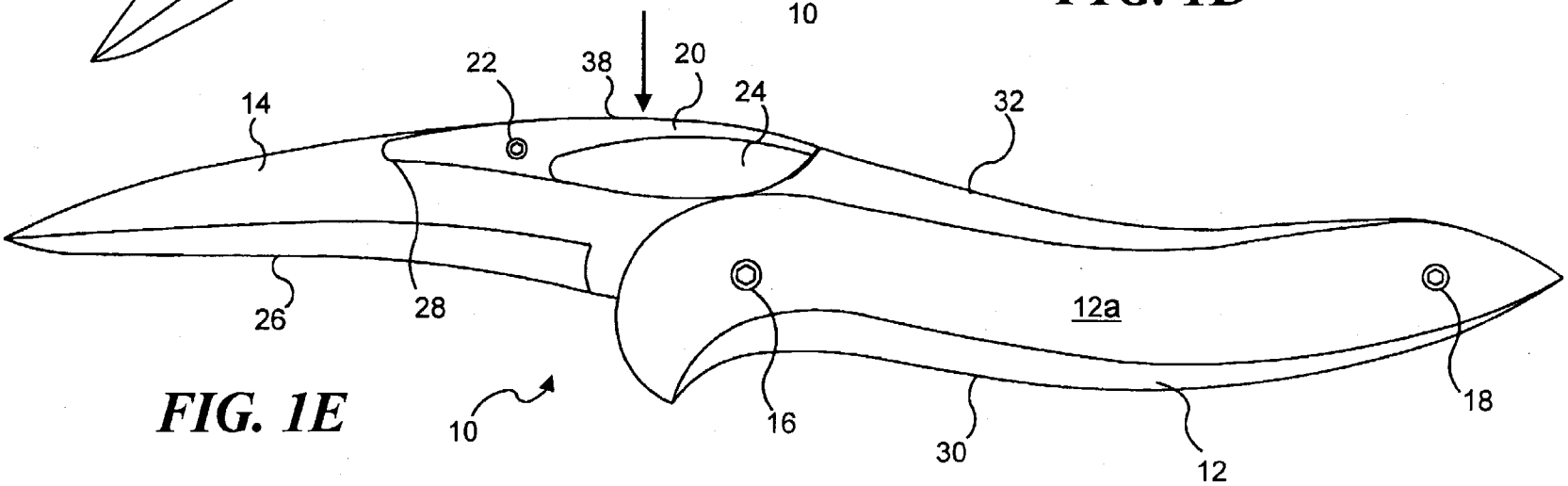

To open blade 14, a user would typically grasp handle 12 with one hand and would grasp gripping surfaces 24 on opposite sides of lever 20 between the thumb and forefinger of the other hand. While grasping gripping surfaces 24 on opposite sides of lever 20, the user would pivot lever 20 about the pivot point defined by the center of threaded Allen screw 22 so that cam surfaces 28 apply a force against sliding surfaces 30 (only one of which is shown in FIG. 1B). The force applied by cam surfaces 28 against sliding surfaces 30 will rotate blade 14, drawing sharpened edge 26 out from between side grips 12*a* and 12*b* of handle 12. Then, as illustrated in FIG. 1C, the user will continue to apply force to gripping surfaces 24, continuing the rotation of blade 14 toward its fully open position, as indicated in FIGS. 1D and 1E.

By using lever 20 to initiate the opening of blade 14 and continuing to apply force through the lever to the blade as the blade is rotated around the pivot point defined by the center of threaded Allen screw 16, direct contact with blade 26 with the user's hands or fingers is easily avoided. However, if the user chooses, once blade 14 is partially open, for example, to the position shown in FIGS. 1B or 1C, the user may optionally grasp the sides of the blade to continue the rotation of the blade to the fully open position. During the opening process, the user will typically grasp handle 12 between the thumb and fingers of one hand, curling the fingers around the back of handle 12 (not over the slot formed between side grips 12*a* and 12*b*), thereby avoiding any possibility of being cut due to an inadvertent release and accidental closure of blade 14. By using lever 20 to pull the blade through its full arc to the open position, this possibility is substantially reduced, compared to the more conventional technique of gripping the blade to open it. Lever 20 can also be used to rotate blade 14 to its closed position.

Figure 3:
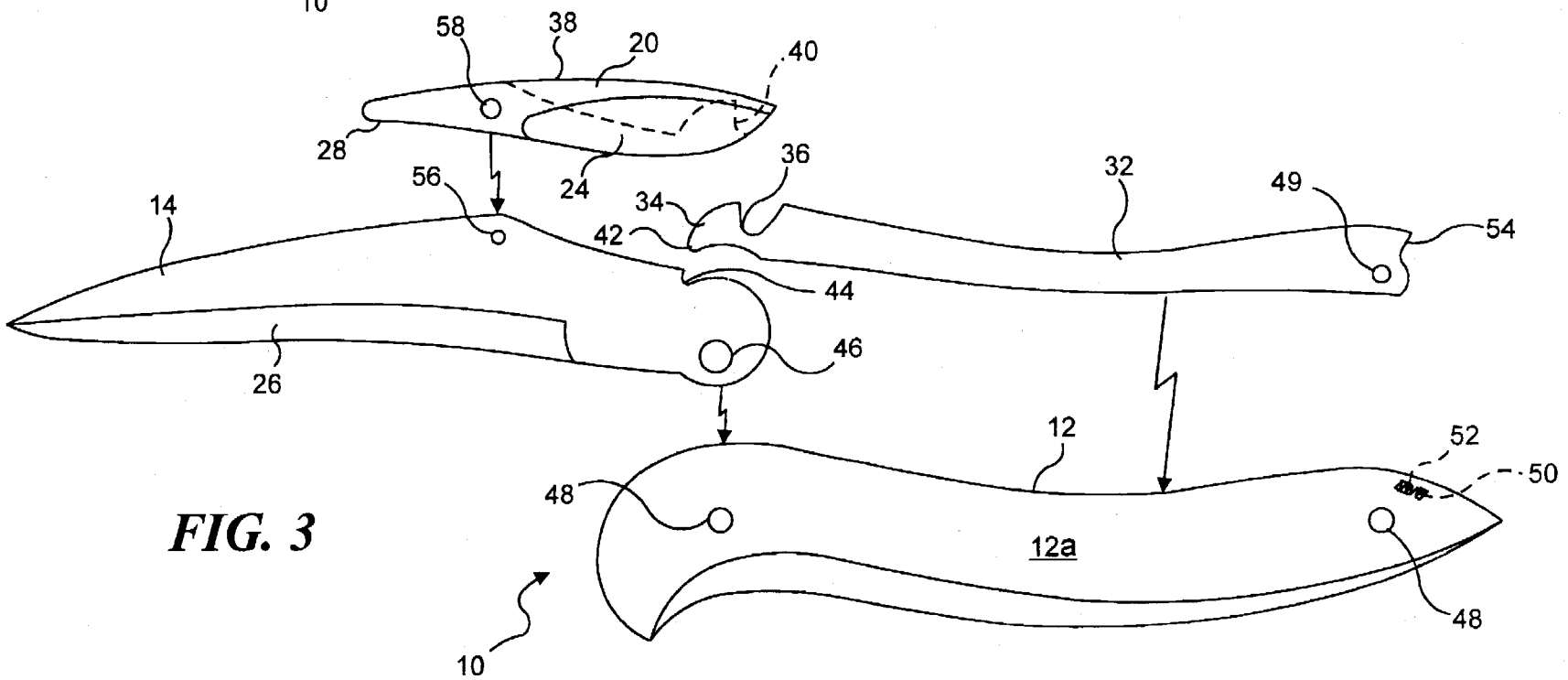
FIG. 3 is a partially exploded side view of the first embodiment of the knife.
Figure 5:
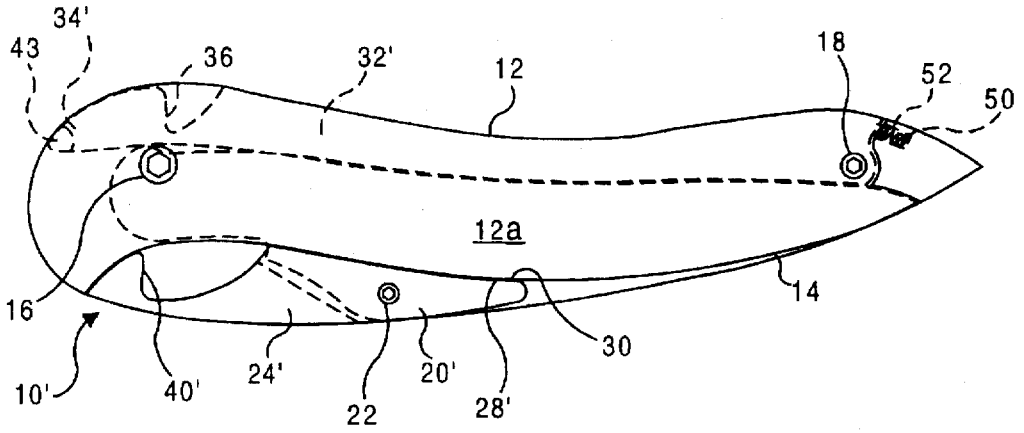
FIG. 5 is a side view of a second embodiment of the knife, with the blade fully closed.
Figure 4:
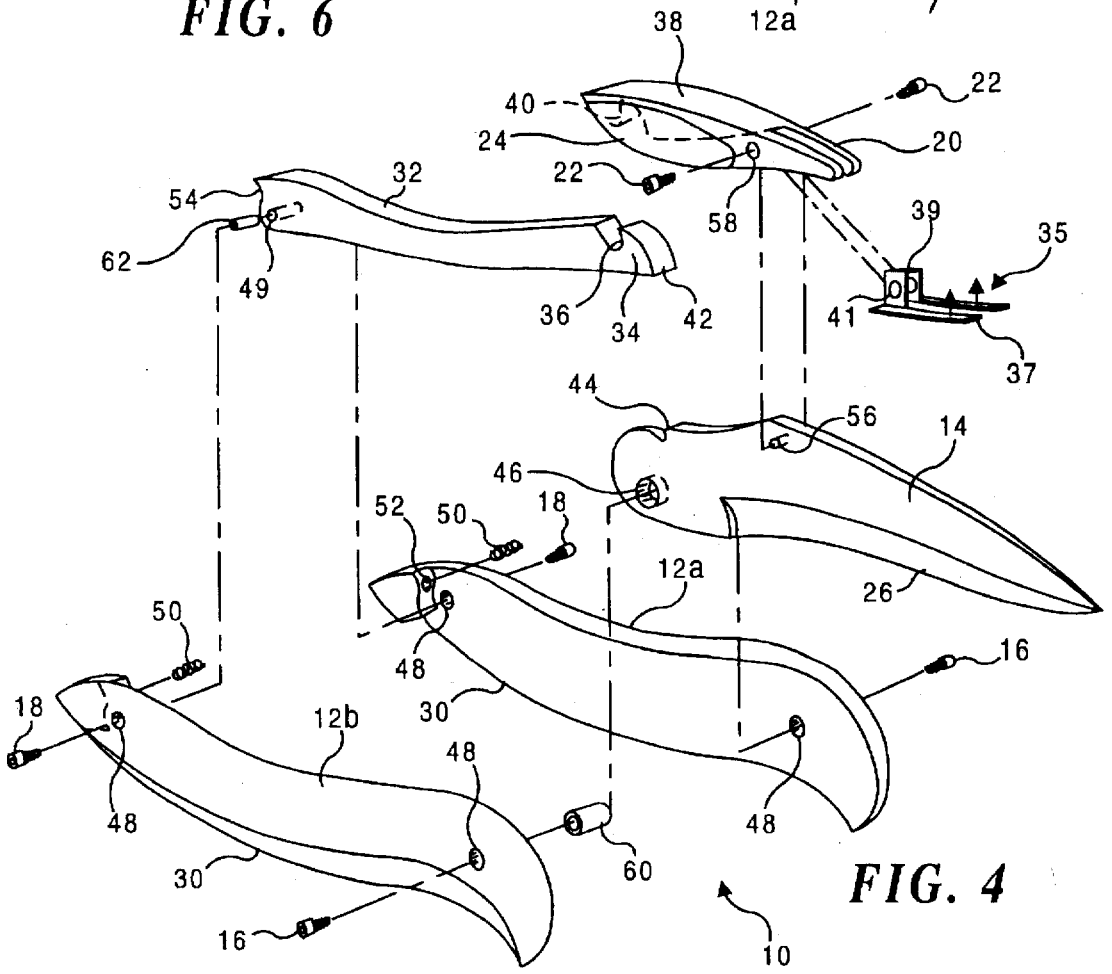
FIG. 4 is an exploded isometric view of the first embodiment of the knife.

As indicated by the dash lines in FIGS. 3 and 4, a contoured latching surface 40 is disposed between gripping surfaces 24 on lever 20. In folding knife 10, contoured latching surface 40 is fully hidden between the two opposed gripping surfaces, creating a stylistically appealing design for lever 20. To lock blade 14 in the fully open position shown in FIG. 1E, contoured latching surface 40 is pivoted into engagement with notch 36 formed in back strip 32 as the blade reaches the fully open position. Engagement of contoured latching surface 40 with notch 36 thus locks the blade in its fully open position. It is also contemplated that notch 36 could instead be disposed on lever 20 and contoured latching surface 40 disposed on back strip 32. In addition, contoured latching surface 40 could be replaced with a rivet or other member extending between gripping surfaces 24 so as to engage notch 36 to lock the blade in the open position. Various other means for engaging lever 20 with handle 12 to lock the blade in the open position are also contemplated within the scope of the present invention.

Referring to FIGS. 3 and 4, rotation of blade 14 from its fully closed position is limited by contact between a shoulder 44 and a nib 42. Shoulder 44 is disposed along the top edge of blade 14, adjacent a pivot orifice 46 through which the blade is pivotally mounted to handle 12. Nib 42 is defined by the tip on end 34 of back strip 32. Back strip 32 rides along the rounded end of blade 14 adjacent pivot orifice 46 as the blade rotates toward the open position, and the rotational motion of the blade is stopped when nib 42 contacts shoulder 44. At this point, contoured latching surface 40 can be engaged by the user with notch 36 in back strip 32, thereby locking blade 14 in the open position so that it cannot be inadvertently closed.

Folding knife 10 uses a helical spring 50 that is seated within a blind pocket 52 in handle 12 to exert a spring bias force against an end 54 of back strip 32. The force applied by helical spring 50 (or alternatively, by two helical springs 50 as illustrated in FIG. 4) tends to rotate back strip 32 around an orifice 49 (shown in FIGS. 3 and 4), so as to maintain end 34 of the back strip in contact with the edge of blade 14. The spring bias force exerted by helical spring(s) 50, which is transmitted through back strip 32, tends to keep blade 14 in the closed position until the user opens the blade as described above, and ensures that nib 42 seats against shoulder 44 as the blade reaches the fully open position.

A further advantage of the present invention arises because a top surface 38 of lever 20 is relatively wider in dimension than the thickness of the spine of blade 14. Typically, a user attempting to cut an object will apply an increased force directly to the blade by placing the pad of the thumb against the spine of the blade. For a conventional knife, the relatively narrow spine of the blade limits the amount of force the user can apply before experiencing pain. In contrast, lever 20 of folding knife 10 has a substantially wider top surface 38, thereby enabling the user to apply substantially greater force against top surface 38 in a relatively safe manner, as indicated by the arrow in FIG. 1E. Force applied with the pad of the thumb against top surface 38 also ensures that lever 20 remains engaged in notch 36.

From the foregoing description, it will be apparent that lever 20 performs three functions in connection with the present invention. Initially, it is used to provide the force that draws blade 14 from its closed position and may be grasped and pulled by the user to continue the rotation of the blade toward the fully open position. Secondly, contoured latching surface 40 within lever 20 engages notch 36 to lock blade 14 in its fully open position. Finally, the relatively broader width of top surface 38 on lever 20 facilitates the application of greater force directed toward the spine of the blade, when cutting an object with folding knife 10.

Further details of folding knife 10 are illustrated in the exploded view of FIG. 4. In this view, it is apparent that threaded Allen screws 22 extend through openings 58 on each side of lever 20 and are threaded into a threaded orifice 56 formed in blade 14. Blade 14 is mounted to handle 12 between side grips 12*a* and 12*b* using two threaded Allen screws 16, which pass through orifices 48 and into an internally threaded bearing 60. The outer surface of internally threaded bearing 60 is cylindrical in shape, and the internally threaded bearing passes through pivot orifice 46 in blade 14. Similarly, an internally threaded bearing 62 is inserted through orifice 49 in back strip 32 to receive the mating threads of threaded Allen screws 18, which pass through orifices 48 on each side of handle 12.

It will be apparent that the threaded Alien screws used in the preferred embodiments of the present invention may be replaced with other types of threaded fasteners. Furthermore, a threaded fastener may extend through an unthreaded orifice on one side of handle 12 and into a threaded aperture on the opposite side of the handle, instead of using two threaded fasteners that are inserted from opposite sides of the handle. In addition, other types of fasteners may be employed for holding the components of the folding knife together, such as rivets.

Figure 2:
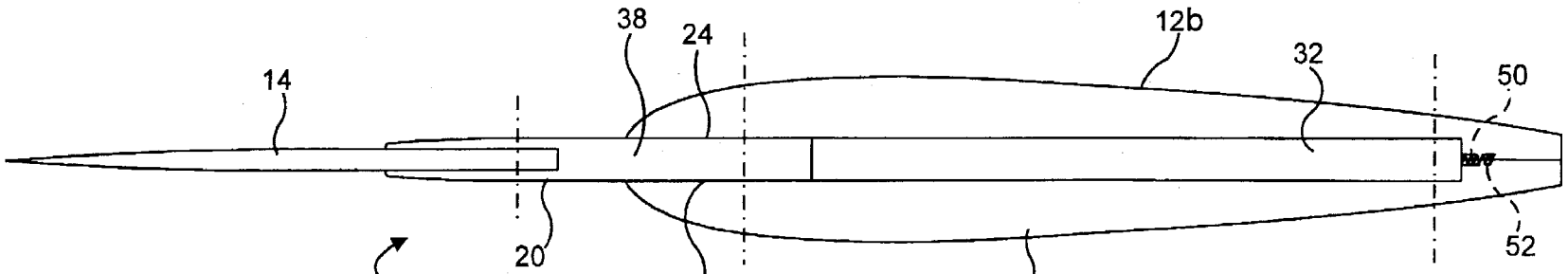
FIG. 2 is a top plan view of the first embodiment of the knife.

In the embodiment shown in FIG. 4, two helical springs 50 apply a force against end surface 54 of back strip 32. However, only a single helical spring 50 may be used if desired, as shown in FIG. 2.

Within a dash-line box, FIG. 4 also illustrates an optional spring assembly 35 which may be included to provide a biasing force that acts on cam surface 28 of lever 20. Spring assembly 35 is made of highly elastic spring steel and includes arms 37 that extend outwardly of a "U-shaped" clip 39 in which are disposed orifices 41. The U-shaped clip fits over the spine of blade 14, with orifices 41 aligned with threaded orifices 56 in the blade. The spring bias force exerted on lever 20 by arms 37 tends to urge contoured latching surface 40 to remain engaged in notch 36, when blade 14 is locked in the fully open position. This spring force minimizes the risk of any accidental release of the contoured latching surface 40 from notch 36, which might enable the blade to be released so that it closes when not intended by the user. However, since spring assembly 35 is considered an optional addition to this and the other embodiments, it is not shown in any other Figures.

A second embodiment of a folding knife 10' is illustrated in FIGS. 5–8. The only significant difference between folding knives 10 and 10' is in regard to the design of the levers used for opening blade 14, locking the blade in the open position, and applying pressure when cutting. In folding knife 10', a lever 20' includes a contoured latching surface 40' that is not enclosed between opposed sides (i.e., between the gripping surfaces of the lever). Further, lever 20' includes opposed gripping surfaces 24' that have a relatively smaller surface area than those on lever 20 of folding knife 10. Because of the differences in the design and shape of levers 20 and 20', a slightly different back strip 32' is used in folding knife 10'. Back strip 32' has a somewhat longer end 34'. Instead of including contoured gripping surfaces 24 of lever 20, gripping surfaces 24' on lever 20' expose contoured latching surface 40', enabling the user to grasp the lever at contoured latching surface 40', using the thumb and forefinger. Rotation of lever 20' forces blade 14 from between side grips **12*a* and 12*b* of handle 12 and allows the user to draw the blade through its rotation toward the fully open position, at which latching contoured surface 40' engages notch 36 in substantially the same manner as described above in connection with lever 20**.

Figure 6:
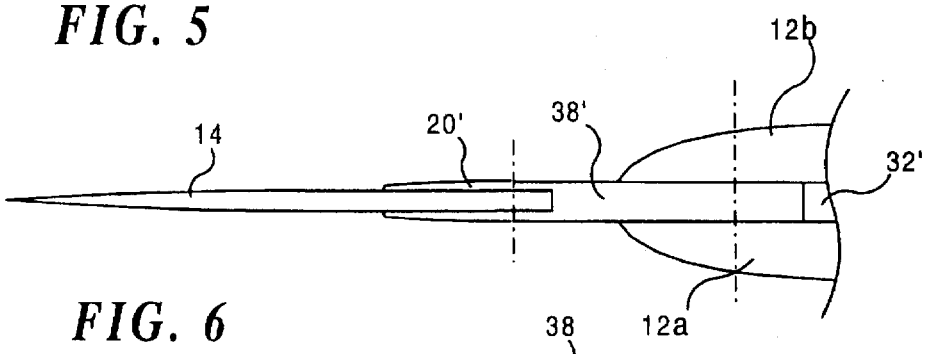
FIG. 6 is a partial top plan view of the second embodiment of the knife, showing the blade locked in the open position.
Figure 7:
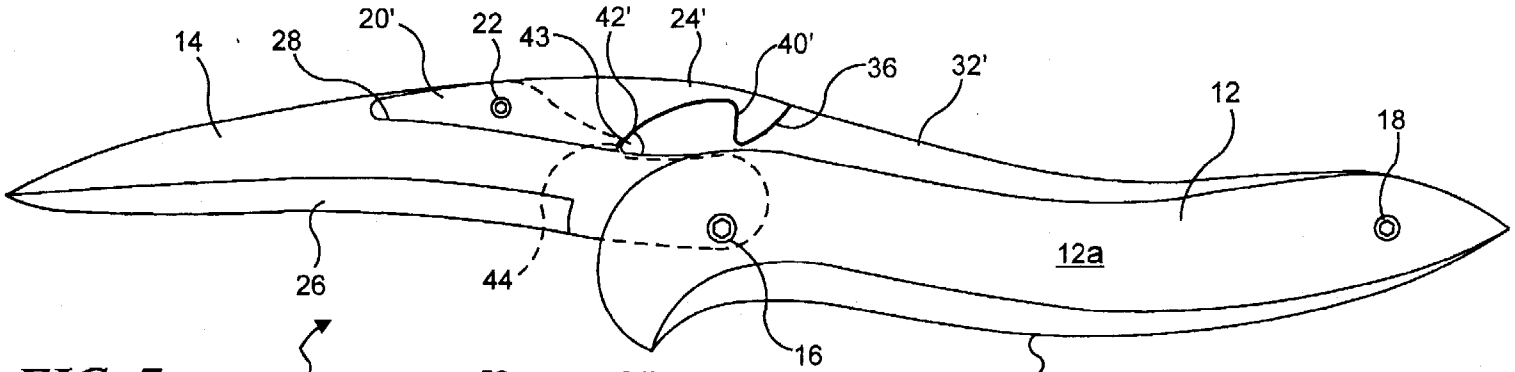
FIG. 7 is a side view of the second embodiment, showing the blade locked in the open position.
Figure 8:
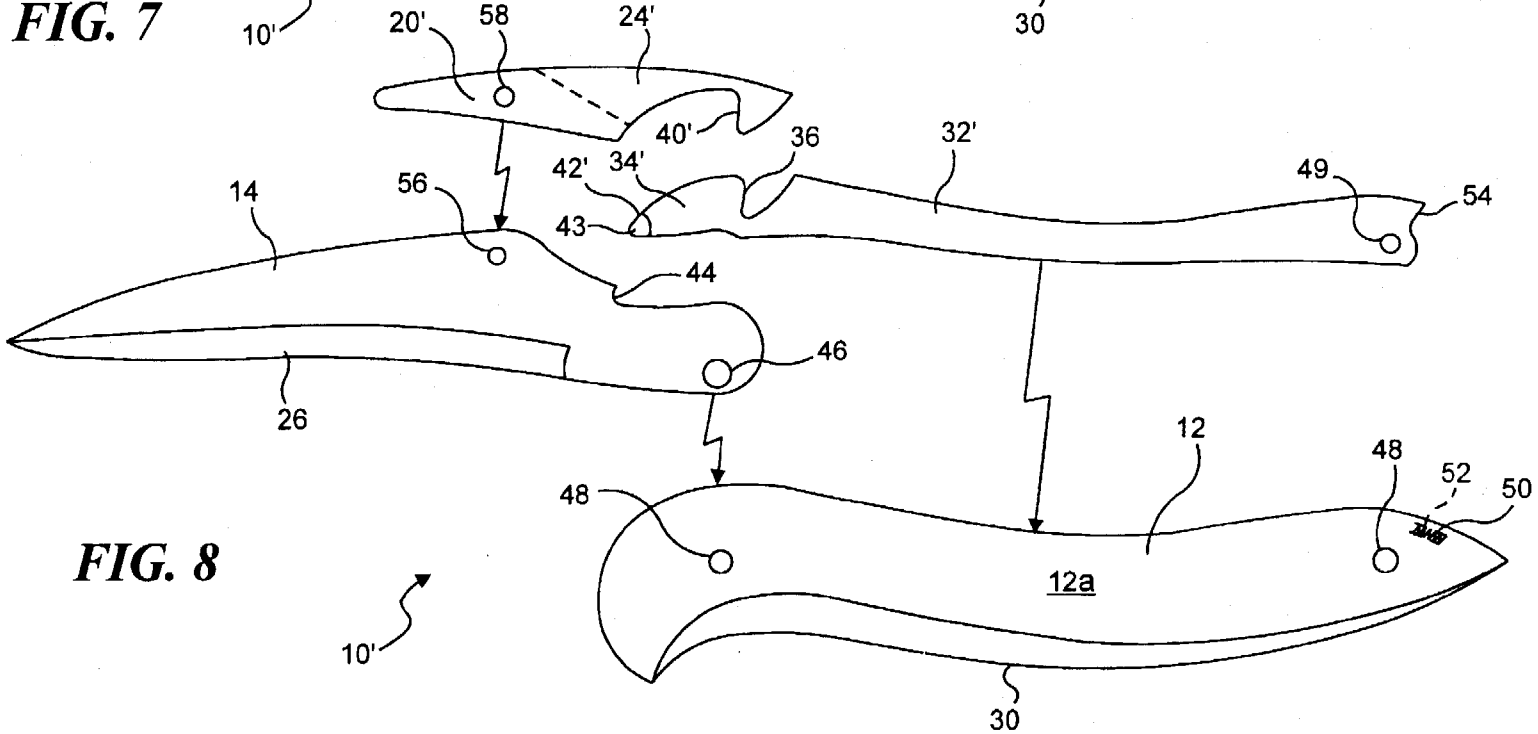
FIG. 8 is a partially exploded side view of the second embodiment of the knife.

As shown in FIG. 7, when blade 14 is fully open, contoured latching surface 40' engages hook 36 on back strip 32', locking blade 14 open. Referring to FIG. 6, it will be evident that a top surface 38' of lever 20' is also substantially wider than the thickness of the spine of blade 14, providing the same enlarged area for supporting the pad of a user's thumb or finger when applying force while cutting with blade 14. Thus, although latching contoured surface 40 is exposed in folding knife 10' instead of hidden as in folding knife 10, in all other respects, the two embodiments operate in substantially the same manner. However, folding knife 10' differs from the first embodiment in one other respect. Preferably, nib 42' includes a cushion 43 comprising an elastomeric material which is compressed by shoulder 44 when blade 14 is fully opened and contoured latching surface 40' has engaged hook 36. Cushion 43 may be applied to nib 42' by dipping the nib into a liquid polymeric plastic, which adheres to the nib after drying and setting, or cushion 43 can be formed with a slot to fit over nib 42' and attached with a suitable adhesive or by a friction fit. Since cushion 43 is compressed against shoulder 44 on the blade, when the blade is open and latched, a positive and intentionally applied force must be applied by the user to disengage contoured latching surface 40' from hook 36, thereby minimizing the risk of accidental and unintended unlatching and closure of the blade.

A third embodiment that provides the same features and functionality of the first two embodiments of the present invention is illustrated in connection with a folding knife 10" shown in FIGS. 9 and 10. In this embodiment, the pivot point defined by the center of threaded Allen screw 16 is shifted to a more central position in the width of a blade 14'. In addition, a back strip 32" used in folding knife 10" is not pivotally mounted, but is instead connected to a handle 12' at two points by threaded Allen screw 18 and a pin (or rivet) 19. The threaded Allen screw is disposed near one end of handle 12', and pin (or rivet) 19 is disposed at about a midpoint along the length of the handle, adjacent the back of the folding knife. It is contemplated that other types of threaded fasteners and/or rivets can be used to couple the components of folding knife 10" together, instead of the threaded Allen screw and rivet used in this third preferred embodiment.

Figure 9:
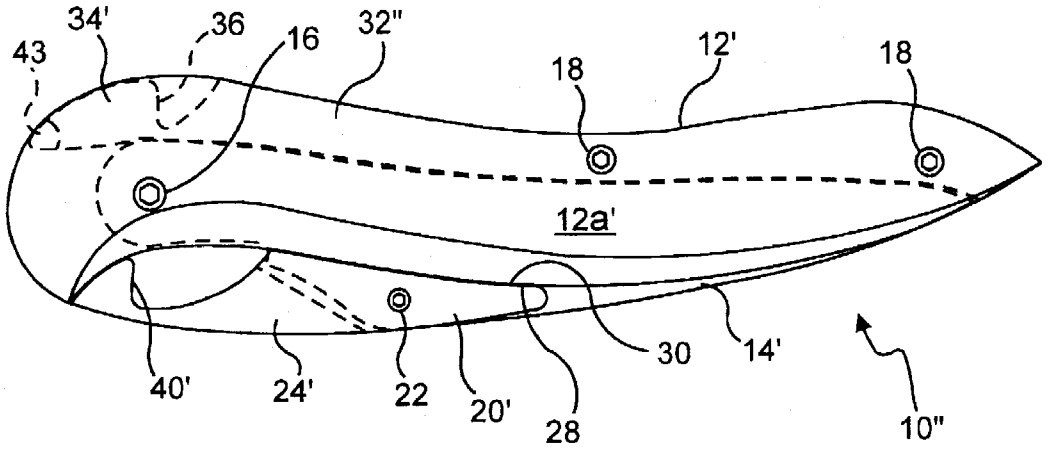
FIG. 9 is a side view of a third embodiment of the knife, showing the blade in the closed position.
Figure 10:
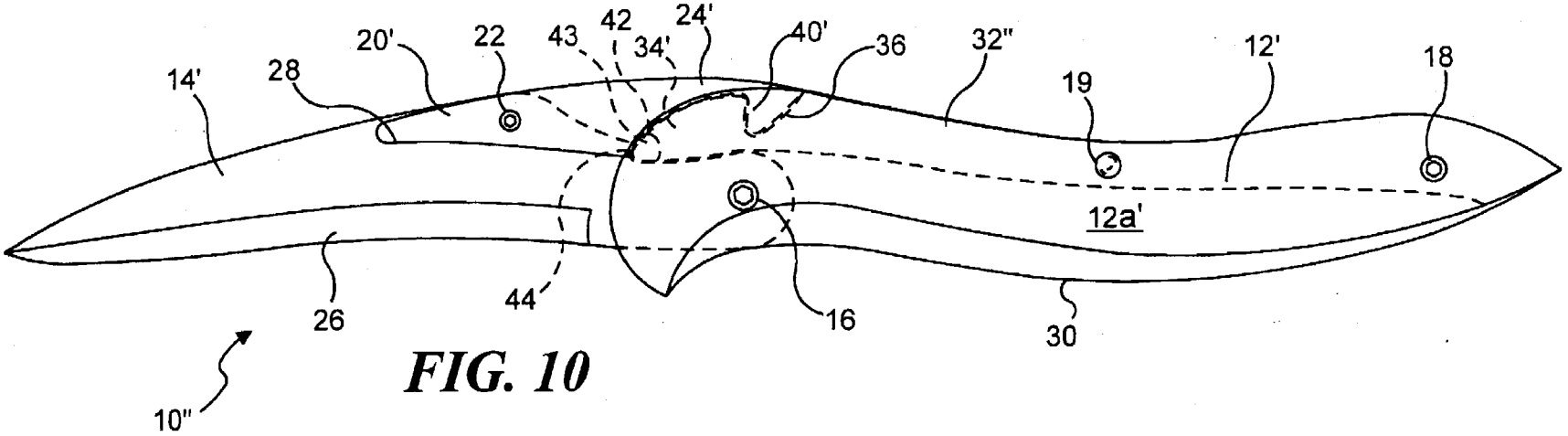
FIG. 10 is a side view of the third embodiment of the knife, showing the blade in the fully open position.

It will be apparent that the free end of back strip 32", which is in contact with blade 14', does not pivot about either of threaded Allen screws 18, but instead flexes outwardly as blade 14' is rotated from the fully closed position shown in FIG. 9, to the fully open position shown in FIG. 10. The inherent flexibility of back strip 32" creates a spring bias force that is applied against the edge of the blade adjacent its pivotal mount, tending to keep blade in its closed position.

When blade 14' is fully open, contoured latching surface 40' seats within notch 36. In this embodiment, the free back strip 32" is substantially fully disposed between the two side grips comprising handle 12' when the blade is locked in the open position. End 34' of back strip 32" is forced slightly out from between the two side grips as blade 14' is rotated to the open position in opposition to the spring bias force exerted by the free end of the back strip, but then moves back between the two side grips when the blade is fully open.

Each of the three preferred embodiments disclosed above includes a contoured handle that provides a comfortable grip when the knife is in use and which is pleasing in appearance. However, it is contemplated that other shapes and contours may be used for a handle in the present invention. Similarly, many other blade designs are contemplated that achieve the benefits provided by the present invention. For example, a pivotal lever like lever 20/20' can be attached to blades having saw tooth or serrated edges instead of sharpened edge 26. Variations such as these are not shown or described in detail, since they comprise aspects of the art that are well known to those of ordinary skill.

Although the present invention has been described in connection with the preferred form of practicing it and modifications thereto, those of ordinary skill in the art will understand that many other modifications can be made to the preferred embodiments within the scope of the claims that follow. Accordingly, it is not intended that the scope of the invention in any way be limited by the above description, but instead be determined entirely by reference to the claims that follow.

The invention in which an exclusive right is claimed is defined by the following:

1. A knife comprising:

(a) a handle that includes two opposed sides and a back, said sides defining an opening that is disposed opposite the back;

(b) a blade that is pivotally attached to the handle at a first pivot point and rotatable about the first pivot point between a closed position wherein the blade is at least partially disposed within the opening between the two sides of the handle, and an open position in which the blade is exposed; and (c) a lockback lever that is pivotally attached to the blade at a second pivot point that is spaced apart from the first pivot point along the blade, said lockback lever engaging the back of the handle to lock the blade in the open position.

2. The knife of claim 1, wherein the lockback lever includes a gripping surface that is exposed when the blade is in the closed position and a cam surface extending along an edge of the lockback lever and disposed adjacent to the handle when the blade is in the closed position, said gripping surface being grippable and rotatable about the second pivot point by a user to rotate the cam surface against the handle, enabling the user to apply force with the lockback lever against the handle, said force causing the blade to rotate about the first pivot point from between the two sides of the handle and toward the open position.

3. The knife of claim 2, wherein the lockback lever includes a latching surface disposed between two side walls comprising the gripping surface, said latching surface engaging a corresponding latching surface formed in the handle to lock the blade in the open position.

4. The knife of claim 1, wherein the lockback lever includes a hook that engages a notch formed in the back of the handle.

5. The knife of claim 1, wherein the back of the handle includes a strip that is disposed between the two sides of the handle, said strip having a contoured surface that engages a corresponding contoured surface on the lockback lever, locking the blade in the open position.

6. The knife of claim 5, wherein one end of the strip is spring biased toward the blade and into contact with an end of the blade, said one end of the strip sliding along the end of the blade and being forced outwardly from between the two sides of the handle by the end of the blade as the blade rotates about the first pivot point when opened.

7. The knife of claim 5, wherein one end of the strip includes an elastomeric cushion that abuts against the blade and is compressed when the blade is fully open, compression of said cushion creating a force that acts on the blade, tending to rotate the blade toward the closed position and thereby applying a force that tends to retain the contoured surface of the strip engaged with the contoured surface of the lockback lever, to prevent the lockback lever from unintentionally disengaging the portion of the handle, minimizing a risk of the blade unintentionally closing.

8. The knife of claim 1, further comprising a spring that is disposed between the blade and the lockback lever, said spring applying a biasing force to the lockback lever tending to rotate it into engagement with the portion of the handle.

9. A knife comprising:

(a) a handle having a longitudinally extending slot formed within it, and a back strip disposed opposite the slot;

(b) a blade having a cutting edge, said blade being pivotally attached to the handle at a first pivot point adjacent one end of the blade and pivotal about said first pivot point between a closed position in which the edge is disposed within the slot and an open position in which the edge is exposed; and (c) a lever pivotally attached to the blade at a second pivot point spaced apart along a length of the blade from the first point at which the blade is pivotally attached to the handle, said lever having a gripping portion that is disposed outside the slot when the blade is in the closed position so that the gripping portion is adapted to be grasped by a user's fingers and rotated about the second pivot point, rotation of the lever bringing an edge of the lever against the handle, forcing the blade from within the slot and toward the open position, said lever being further pivotal about the second pivot point to engage the back strip of the handle at a point spaced apart from the first pivot point when the blade is fully opened, to lock the blade in the open position.

10. The knife of claim 9, wherein one end of the back strip contacts the blade, and the blade forces the end of the back strip outwardly from the handle as the blade is rotated about the first pivot point.

11. The knife of claim 9, wherein the handle comprises two grips, each disposed on opposite sides of the slot.

12. The knife of claim 11, wherein said back strip is spring biased towards a position between the two grips of the handle, and an end of the back strip that is in contact with the blade is forced outwardly of the handle, from between the two grips, by an end of the blade adjacent to the first pivot point, as the blade is opened.

13. The knife of claim 10, wherein one of the gripping portion of the lever and the back strip includes a hook that engages a surface of the other of the lever and the back strip, to lock the blade in the open position.

14. The knife of claim 13, wherein one end of the back strip includes an elastomeric cushion that contacts the blade and is compressed by the blade when the blade is fully open, compression of said elastomeric cushion by the blade when fully opened causing the elastomeric cushion to produce a force against the blade tending to rotate the blade about the first pivot point toward the closed position to keep the hook and surface engaged and the blade locked in the open position, thereby preventing an unintentional closure of the blade.

15. The knife of claim 10, wherein the gripping portion of the lever includes a contoured surface that latchingly engages a mating portion of the back strip.

16. The knife of claim 15, wherein the gripping portion of the lever comprises opposed side walls that at least partially enclose the contoured surface.

17. The knife of claim 9, wherein the lever is thicker than the blade and thus provides a wider surface than a top surface of the blade's spine, so that the user may more comfortably selectively exert force against the wider surface of the lever when using the knife while the blade is in the open position.

18. The knife of claim 9, wherein the lever has two opposed ends; said gripping portion being disposed adjacent one end of the lever, and an edge of the lever that slides against the handle when the lever is rotated to force the blade from within the slot being disposed adjacent the other end of the lever, rotation of the lever when the blade is in the closed position causing the edge of the lever to slide along the handle and apply a force to the second pivot point that rotates the blade about the first pivot point and out of the slot.

19. The knife of claim 9, further comprising a spring disposed between the lever and the blade, said spring providing a biasing force against the lever that pivots the lever about the second pivot point in a direction in which it engages the back strip of the handle, thereby tending to maintain the blade locked in the open position, minimizing a risk of an unintended unlocking and closure of the blade.

20. A knife comprising:

(a) a handle for holding the knife when the knife is being used;

(b) a blade that is pivotally mounted to the handle at a first pivot point disposed adjacent one end of the blade, said blade being thus rotatable about the pivot point between an open position in which the blade is exposed and a closed position in which the blade is at least partially seated within the handle; and (c) a lever that is pivotally mounted to the blade at a second pivot point spaced apart along a length of the blade from the first pivot point at which the blade is mounted to the handle, said lever having a gripping portion that is substantially exposed when the blade is in the closed position, adapting the lever to be readily grasped by a user, rotation of the lever bringing an edge of the lever into contact with the handle and applying a force to the second pivot point as the edge of the lever slides along the handle that tends to rotate the blade about the first pivot point from the closed position toward the open position, enabling the user to rotate the blade toward the open position with the lever, without initially gripping the blade itself.

21. The knife of claim 20, wherein the lever includes a latching surface, and the handle includes a corresponding latching surface, said lever being rotatable to engage the latching surface on the lever with the corresponding latching surface on the handle to lock the blade in the open position.

22. The knife of claim 20, wherein the lever and the handle include lockback means for locking the blade in the open position.

23. The knife of claim 20, wherein the gripping portion of the lever comprises opposed side walls.

24. The knife of claim 23, wherein a contoured latching surface is disposed between the opposed side walls of the gripping portion, and wherein the handle includes a mating latching surface that is engaged by the contoured latching surface of the gripping portion when the lever is rotated to a lockback position, to secure the blade in the open position.

25. The knife of claim 20, wherein one of the gripping portion of the lever and the handle includes a hook, and wherein the other of the gripping portion and the handle includes a receiver for the hook, said lever being rotatable to engage the receiver with the hook to lock the blade in the open position.

26. The knife of claim 20, wherein the gripping portion of the lever is substantially thicker than the blade, said gripping portion providing a wider surface than a spine of the blade, against which the user may apply a force that is directed toward the blade.

* * * * *